United States Patent [19]

Swinton

[11] Patent Number: 4,730,598

[45] Date of Patent: Mar. 15, 1988

[54] DRAFT-ASSISTING CHAMBER

[76] Inventor: Michael C. Swinton, 27 Gentle Gate Crescent, Ottawa, Ontario, Canada, K1T 1Z9

[21] Appl. No.: 900,082

[22] Filed: Aug. 25, 1986

[30] Foreign Application Priority Data

Aug. 27, 1985 [CA] Canada ..... 489426

[51] Int. Cl.[4] ..... F24C 1/14

[52] U.S. Cl. ..... 126/80; 126/21 R; 126/99 R; 126/103

[58] Field of Search ..... 126/80, 21 R, 21 A, 126/389, 103

[56] References Cited

U.S. PATENT DOCUMENTS

| | | | |
|---|---|---|---|
| 203,117 | 4/1878 | Campbell | 126/80 |
| 1,417,030 | 5/1922 | Carmichael | 126/80 |
| 1,468,165 | 9/1923 | Moore | 126/80 |
| 1,757,898 | 5/1930 | Bushman et al. | 126/80 X |
| 2,619,022 | 11/1952 | Hergenrother | 126/80 X |

*Primary Examiner*—Larry Jones

*Attorney, Agent, or Firm*—Nixon & Vanderhye

[57] ABSTRACT

A draft-assisting chamber is positioned between the combustion chamber and the flue pipe of a heating appliance so as to capture combustion gases in a quantity sufficient to initiate gas flow through the flue pipe. By use of the chamber, gas flow is initiated in the flue pipe during conditions that would otherwise delay such initialization.

14 Claims, 4 Drawing Figures

DRAFT-ASSISTING CHAMBER

This invention relates to a heating appliance modification, and more particularly, to a chamber adapted to extend from the combustion gas exhaust port of a heating appliance for containing the buoyant exhaust gases to enhance the capability of the heating appliance to initiate flue pipe flow.

A number of early United States patents disclose means for ventilating a room in which a stove is located. Those references each disclose an apparatus in which the flow of the combustion gases exhausted from the stove creates a venturi effect to draw air adjacent to the stove into the exhaust gas flow. U.S. Pat. No. 325,243, granted to B. J. Goldsmith on Sept. 1, 1885, discloses a ventilating attachment that may be positioned on the floor of a building adjacent to a stove for introducing a regulated quantity of ambient room air into the exhaust gas flow of the stove. As illustrated in FIG. 2 of that reference, a venturi construction is internal of the stove exhaust pipe. A similar arrangement is illustrated in U.S. Pat. No. 345,107 granted to W. M. Brinkerhoff on July 6, 1886. U.S. Pat. Nos. 354,765 and 354,766, granted to W. M. Brinkerhoff on Dec. 21, 1886, disclose a ventilating attachment for a stove similar in operation to the foregoing attachments but formed as an integral part of the body of the stove. U.S. Pat. No. 656,895, granted to F. L. King on Aug. 28, 1900, discloses a combined damper regulator and ventilator in which air drawn from adjacent the stove for mixing with the stove exhaust gases can be metered at the mixing location. The disclosures of U.S. Pat. Nos. 1,169,661; 1,223,483; 1,417,030; 1,439,925; 1,655,858; 1,757,898; and 1,967,128 also relate to ventilator devices in which ambient air from adjacent a stove is mixed with exhaust gases from the stove.

None of the aforementioned references appear to be directed toward the temporary containment of exhaust gases produced by a heating appliance for creating a buoyant force to assist in initializing flue pipe flow. Besides creating such a buoyant force, the chamber of the invention also reduces the amount of combustion gases, including gases hazardous to human health, that are expelled into the room in which the heating appliance is located. The addition of the containment chamber of the invention to a conventional heating appliance is intended not to interfere with the atmospheric nature of the appliance. The chamber is sufficiently large and open that there should be no effect on the combustion process at steady-state conditions.

The subject invention is a chamber adapted to contain exhaust gases produced after start-up of a heating appliance but prior to establishment of steady-state flow in the flue pipe of the heating appliance. The chamber is adapted to be positioned proximate of the combustion gas exhaust port of the heating appliance and the flue pipe attached to the heating appliance, and is adapted to be in flow communication with both the exhaust port and the flue pipe. The horizontal cross-section of the chamber at all vertical positions has a mean area at least approximately four times the area of the exhaust port. The roof of the chamber is above the exhaust port of the heating appliance such that exhaust gas from the heating appliance flows generally laterally into the upper portion of the chamber. The flue pipe is connected to the chamber at a position above the exhaust port of the heating appliance. The chamber extends downwardly from the exhaust port a substantial portion of the height of the heating appliance, the inside of the chamber being in flow communication with ambient air outside of the heating appliance through at least one aperture proximate of the bottom of the chamber. The initial exhaust gases leaving the heating appliance through the exhaust port after start-up of the heating appliance and prior to a sufficient draft being created in the flue pipe are collected in the chamber. Those exhaust gases spread in a downward direction in the chamber until such time as their buoyancy creates the steady-state flow in the flue pipe. The height of the chamber is sufficient to accommodate such temporary collection of exhaust gases.

The chamber may be adapted to be fitted to the heating appliance, that arrangement being such that the chamber is adjacent to a different face of the heating appliance from that face through which air is drawn into the heating appliance for the combustion process. The horizontal cross-section of the chamber may be generally the same for all vertical positions. The heating appliance may be a furnace, a water heater, or other combustion appliance. The bottom end of the chamber may terminate proximate of the base of the heating appliance; in such a form of the invention, the chamber and the heating appliance may be housed in a common casing with the chamber and heating appliance each having one of its faces defined by a common wall within that casing. In such common casing arrangement, the height and width of the chamber may correspond to the height and width of the heating appliance with the combustion gas exhaust port of the heating appliance extending through the common wall. Also, in such arrangement the aperture proximate of the lower end of the chamber is formed in that face of the chamber opposite to the face defining the common wall.

An exhaust gas sensor may be positioned within the chamber a selective distance above the aperture in the lower end of the chamber. The sensor creates a human detectable alarm when exhaust gases have spread a sufficient distance downward in the chamber to contact the sensor.

The chamber of the invention will next be more fully described in terms of two preferred embodiments utilizing the accompanying drawings, in which.

Figure 1:
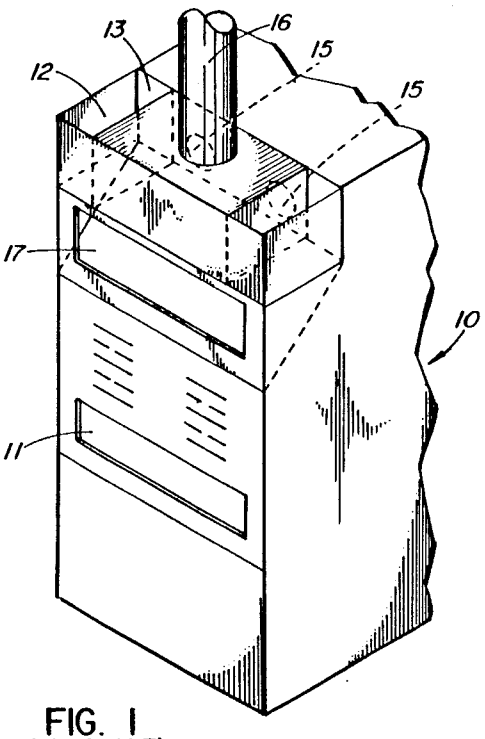
FIG. 1 (PRIOR ART)
FIG. 1 is a perspective view of a portion of a known type of furnace and combustion gas dilution device integrated into a common casing.

FIG. 1 illustrates one furnace construction known in the prior art. Furnace 10 has an aperture 11 on its one face through which air enters the furnace for the combustion process. Furnace 10 has a draft-assisting chamber, generally designated as 12, incorporated into it as illustrated in FIG. 1. One of the walls of chamber 12 is wall 13 which is in common with the remainder of furnace 10. Combustion gases from the combustion process within furnace 10 pass through one of the two apertures 15 in wall 13. After steady-state flow is established in flue pipe 16, all of the combustion gases passing through the pair of apertures 15 pass into flue pipe 16 which connects to a chimney external of the building that houses furnace 10. An aperture 17 is provided in chamber 12 such that air surrounding furnace 10 may be drawn through aperture 17 for mixing with the exhaust gases entering flue pipe 16.

There is a short time interval between the start-up of the combustion process in furnace 10 and the establishment of steady-state flow of combustion gases through flue pipe 16. The time interval can be of the order of 10 to 20 seconds, although there may be no time or it may last longer. The time interval is a function of the available draft of the flue at stand-by; that draft can be quite low or there may even be a reverse draft initially. As will be evident from an examination of FIG. 1, without steady-state flow being established in flue pipe 16 combustion gas passing through apertures 15 will rapidly fill the minuscule volume of chamber 12 and will then move downwardly and be expelled through aperture 17. The proximity of aperture 17 to the air inlet 11 of furnace 10 creates additional difficulties in that air being drawn through air inlet 11 encourages the drawing of combustion gases from chamber 12 through aperture 17.

Figure 2:
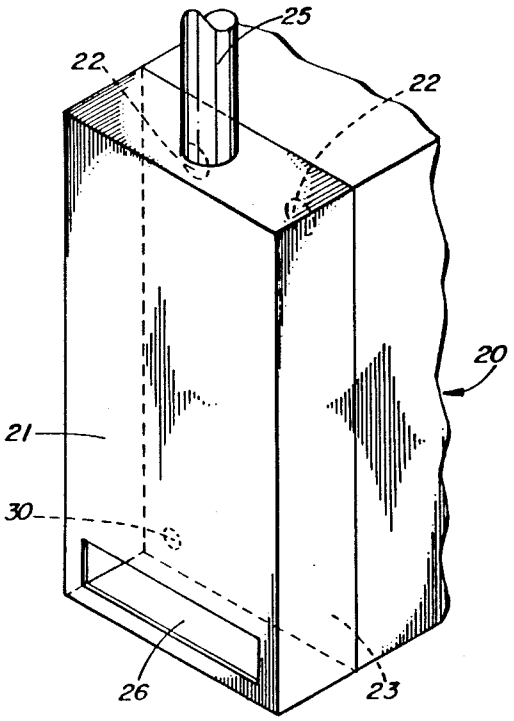
FIG. 2 is a perspective view of a portion of the combustion gas collection chamber of the invention and a furnace integrated into a casing having a common wall, the view illustrating the first preferred embodiment of the invention.

FIG. 2 illustrates a furnace generally designated as 20 and a collection chamber 21 which is housed within a casing common to furnace 20. Combustion gases leave furnace 20 through the pair of apertures 22 in the common wall 23. Prior to establishment of steady-state flow through flue pipe 25, the combustion gases produced immediately after start-up of furnace 20 enter the top portion of collection chamber 21 and from there spread downwardly toward the aperture 26 positioned proximate of the lower end of chamber 21. Aperture 26 connects the interior of chamber 21 with the ambient air surrounding furnace 20. From a comparison of FIGS. 1 and 2 it can be seen that the major construction difference between the furnaces illustrated in those drawings relates to the height of the chamber in which combustion gases are temporarily stored during start-up of the furnace. For space limitations it would be undesirable to have a combustion gas collection chamber of the type illustrated in FIG. 2 with a cross-sectional area many times greater than the aggregate cross-sectional area of exhaust ports 22; it has been found, however, than an effective device may be produced when the ratio of the cross-sectional areas is as low as four. A suggested operative value for the ratio is five.

With respect to the embodiment of FIG. 2, the air inlet port of the furnace is located on the opposite face of furnace 20 from that on which chamber 21 is positioned. That construction is necessary to avoid the air inlet port of furnace 20 drawing combustion gases out through aperture 26.

Figure 3:
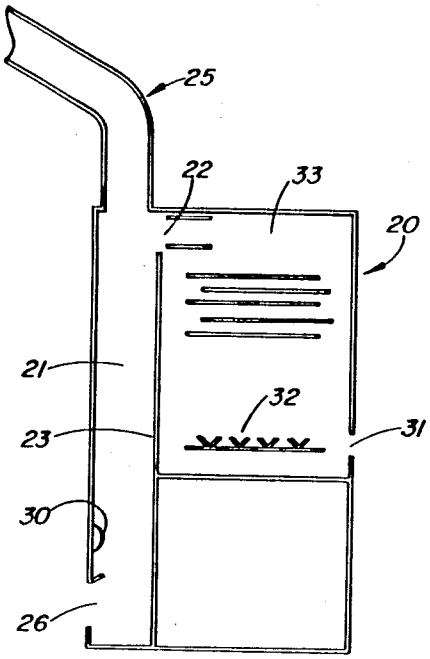
FIG. 3 is a sectioned side view of the combustion gas collection chamber and furnace of the first preferred embodiment of the invention.

A combustion gas sensor 30 is positioned proximate of and centrally above aperture 26 and within chamber 21. Sensor 30 emits an audible signal whenever combustion gases have spread sufficiently downward in chamber 21 that they come into contact with sensor 30. Besides emitting an audible alarm, alarm 30 may be connected to means for preventing or reducing the amount of combustion gases produced in furnace 20. FIG. 3 illustrates a sectioned side view of the furnace construction illustrated in the perspective view of FIG. 2. Air is drawn into the furnace through air inlet 31, which is positioned on an opposite face of furnace 20 from the face adjacent to chamber 21. Combustion gas produced by flame ring 32 passes upwardly in combustion chamber 33, and during such passage gives off heat to air being circulated through ducts extending from the furnace throughout the building.

Figure 4:
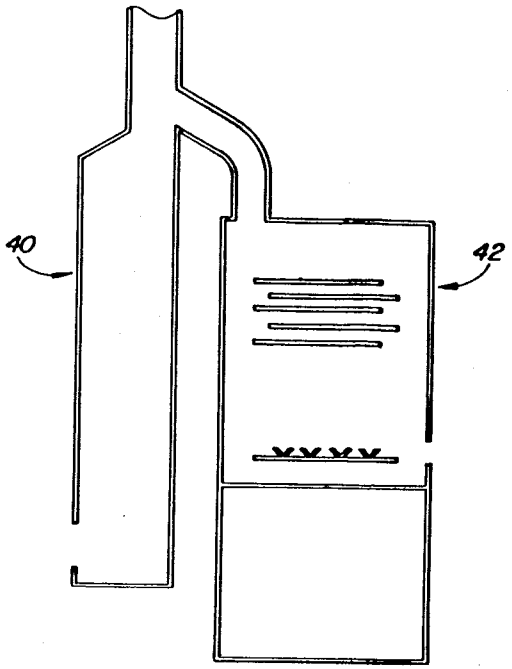
FIG. 4 is a side view of the combustion gas collection chamber of the invention mounted to the flue pipe of a furnace, the view illustrating a second preferred embodiment of the invention.

FIG. 4 illustrates an embodiment in which the draft assisting chamber generally designated 40 is at a position remote from furnace 42. The only difference between the embodiments of FIGS. 3 and 4 relates to the physical separation of combustion gas collection chamber 40 from furnace 42.

Although the described preferred embodiments have related to furnaces, the invention could as easily be utilized with a water heater. With respect to water heaters, the draft-assisting chamber does not usually share a common casing with the furnace. The containment chamber for the water heater is instead connected into the flue pipe of the water heater and is of a similar separate construction to that disclosed with respect to the furnace 42 of FIG. 4.

The draft-assisting chamber of the subject invention has been shown to adequately contain combustion gases produced by furnaces and water heaters between start-up of that equipment and establishment of steady-state gas flow through the flue pipe.

I claim:

1. A generally vertical chamber adapted to be positioned proximate of the combustion gas exhaust port of a heating appliance and of the flue pipe attached to the heating appliance and to be in flow communication with both the exhaust port and the flue pipe, the horizontal cross-section of the chamber at all vertical positions having a mean area at least approximately four times the area of the exhaust port, the roof of the chamber being above the exhaust port of the heating appliance such that exhaust gas from the heating appliance flows generally laterally into the upper portion of the chamber, the flue pipe being connected to the chamber at a position above the exhaust port of the heating appliance, the chamber extending downwardly from the exhaust port a substantial portion of the height of the heating appliance, the inside of the chamber being in flow communication with ambient air outside of the heating appliance through at least one aperture proximate of the bottom of the chamber, whereby the initial exhaust gases leaving the heating appliance through the exhaust port after start-up of the heating appliance and prior to a sufficient draft being created in the flue pipe are collected in the chamber, those exhaust gases spreading in a downward direction in the chamber until such time as their buoyancy creates the steady-state draft in the flue pipe, the height of the chamber being sufficient to provide such buoyancy and the volume of the chamber being sufficient to accommodate such temporary collection of exhaust gases.

2. A generally vertical chamber as in claim 1, wherein the mean horizontal cross-section of the chamber is approximately four times the area of the exhaust port.

3. A generally vertical chamber as in claim 1, wherein the mean horizontal cross-section of the chamber is approximately five times the area of the exhaust port.

4. A generally vertical chamber as in claim 1, wherein the heating appliance is a furnace.

5. A generally vertical chamber as in claim 1, wherein the heating appliance is a water heater.

6. A generally vertical chamber as in claim 1, wherein the bottom end of the chamber terminates proximate of the base of the heating appliance.

7. A generally vertical chamber as in claim 6, wherein the chamber and the heating appliance are housed in a common casing, the chamber and heating appliance each having one of its faces defined by a common wall within that casing, whereby the height and width of the chamber corresponds to the height and width of the heating appliance, and the combustion gas exhaust port of the heating appliance extends through the common wall.

8. A generally vertical chamber as in claim 7, wherein the aperture proximate of the lower end of the chamber is formed in that face of the chamber opposite to the face defining the common wall.

9. A generally vertical chamber as in claim 6, wherein the heating appliance is a furnace.

10. A generally vertical chamber as in claim 1, wherein the chamber is adapted to be fitted to the heating appliance, that arrangement being such that the chamber is adjacent to a different face of the heating appliance from that face through which air is drawn into the heating appliance for the combustion process.

11. A generally vertical chamber as in claim 1, wherein the horizontal cross-section of the chamber is generally the same for all vertical positions.

12. A generally vertical chamber as claimed in claim 1, in which chamber extends downwardly from the exhaust port a vertical distance which is greater than any horizontal dimension of said chamber at the level of the exhaust port.

13. A generally vertical chamber adapted to be positioned proximate of the combustion gas exhaust port of a heating appliance and of the flue pipe attached to the heating appliance and to be in flow communication with both the exhaust port and the flue pipe, the horizontal cross-section of the chamber at all vertical positions having a mean area at least approximately four times the area of the exhaust port, the roof of the chamber being above the exhaust port of the heating appliance such that exhaust gas from the heating appliance flows generally laterally into the upper portion of the chamber, the flue pipe being connected to the chamber at a position above the exhaust port of the heating appliance, the chamber extending downwardly from the exhaust port a substantial portion of the height of the heating appliance, the inside of the chamber being in flow communication with ambient air outside of the heating appliance through at least one aperture proximate of the bottom of the chamber, whereby the initial exhaust gases leaving the heating appliance through the exhaust port after start-up of the heating appliance and prior to a sufficient draft being created in the flue pipe are collected in the chamber, those exhaust gases spreading in a downward direction in the chamber until such time as their buoyancy creates the steady-state draft in the flue pipe, the height of the chamber being sufficient to provide such buoyancy and the volume of the chamber being sufficient to accommodate such temporary collection of exhaust gases, and an exhaust gas sensor positioned within the chamber a selective distance above the said at least one aperture proximate the bottom of the chamber, the exhaust gas sensor creating a human detectable alarm when exhaust gases have spread downwardly in the chamber a sufficient distance to contact the sensor.

14. A generally vertical chamber as claimed in claim 13, in which said exhaust gas sensor also comprises means to reduce or prevent the creation of combustion gases of said heating appliance.

* * * * *